US006323594B1

(12) United States Patent
Janning

(10) Patent No.: US 6,323,594 B1
(45) Date of Patent: Nov. 27, 2001

(54) ELECTRON AMPLIFICATION CHANNEL STRUCTURE FOR USE IN FIELD EMISSION DISPLAY DEVICES

(75) Inventor: John L. Janning, Dayton, OH (US)

(73) Assignee: St. Clair Intellectual Property Consultants, Inc., Grosse Pointe, MI (US)

( * ) Notice: Subject to any disclaimer, the term of this patent is extended or adjusted under 35 U.S.C. 154(b) by 0 days.

(21) Appl. No.: 09/338,620

(22) Filed: Jun. 23, 1999

Related U.S. Application Data

(63) Continuation-in-part of application No. 08/955,880, filed on Oct. 22, 1997, now abandoned, which is a continuation-in-part of application No. 08/852,228, filed on May 6, 1997, now Pat. No. 5,982,082.

(51) Int. Cl.[7] ..... H01J 1/62; H01J 63/04; H01J 29/70; H01J 43/00

(52) U.S. Cl. ..... 313/495; 313/496; 313/497; 313/105 R; 313/105 CM; 313/103 CM; 313/422

(58) Field of Search ..... 313/422, 495.97, 313/103 CM, 105 CM, 309, 336, 351, 103 R, 105 R, 106, 107, 292

(56) References Cited

U.S. PATENT DOCUMENTS

| | | |
|---|---|---|
| 2,992,349 | 7/1961 | Cusano . |
| 3,560,784 | 2/1971 | Steel . |
| 4,023,063 | 5/1977 | King et al. . |
| 4,028,575 | 6/1977 | Van Raalte . |
| 4,041,343 | 8/1977 | Orthuber . |
| 4,381,474 | 4/1983 | Cusano . |
| 4,540,914 | 9/1985 | Maple . |
| 4,857,161 | 8/1989 | Borel et al. . |
| 5,229,331 | 7/1993 | Doan et al. . |
| 5,378,963 | 1/1995 | Ikeda . |
| 5,384,509 | 1/1995 | Kane et al. . |
| 5,438,240 | 8/1995 | Cathey et al. . |
| 5,461,280 | 10/1995 | Kane . |
| 5,473,218 | 12/1995 | Moyer . |
| 5,473,219 | 12/1995 | Ikeda . |
| 5,509,839 | 4/1996 | Liu . |
| 5,534,749 | 7/1996 | Ohoshi et al. . |
| 5,646,479 | 7/1997 | Troxele . |
| 5,656,887 | 8/1997 | Voshell et al. . |
| 5,821,685 | 10/1998 | Peterson . |

*Primary Examiner*—Nimeshkumar D. Patel
*Assistant Examiner*—Mack Haynes
(74) *Attorney, Agent, or Firm*—Harness, Dickey & Pierce, P.L.C.

(57) ABSTRACT

Cathodoluminescent field emission display devices features an electron amplification structure for generating secondary electron emissions. The electron amplification structure includes a channel structure having a bottom wall coupled to at least one side wall, thereby defining a channel cavity, and at least one protrusion extending from the side wall into the channel cavity. Furthermore, a primary electron source or emitter is provided for generating primary electron emission into the channel cavity, whereby secondary emissions of electrons are produced when the protrusion is bombarded by electrons within the channel structure. The use of a narrow channel in the electron amplification structure reduces the possibility that a returning ion will strike the emitter, and thus decreases cathode emitter tip erosion.

25 Claims, 7 Drawing Sheets

ELECTRON AMPLIFICATION CHANNEL STRUCTURE FOR USE IN FIELD EMISSION DISPLAY DEVICES

This application is a continuation-in-part of application U.S. Ser. No. 08/955,880, filed Oct. 22, 1997 now abandoned which is a continuation-in-part of application U.S. Ser. No. 08/852,228, filed May 6, 1997 now U.S. Pat. No. 5,982,082.

This invention relates to electronic field emission display devices, such as matrix-addressed monochrome and full color flat panel displays in which light is produced by using cold-cathode electron field emissions to excite cathodoluminescent material. Such devices use electric fields to induce electron emissions, as opposed to elevated temperatures or thermionic cathodes as used in cathode ray tubes.

BACKGROUND OF THE INVENTION

Cathode ray tube (CRT) designs have been the predominant display technology, to date, for purposes such as home television and desktop computing applications. CRTs have drawbacks such as excessive bulk and weight, fragility, power and voltage requirements, electromagnetic emissions, the need for implosion and X-ray protection, analog device characteristics, and an unsupported vacuum envelope that limits screen size. However, for many applications, including the two just mentioned, CRTs have present advantages in terms of superior color resolution, contrast and brightness, wide viewing angles, fast response times, and low cost of manufacturing.

To address the inherent drawbacks of CRTs, such as lack of portability, alternative flat panel display design technologies have been developed. These include liquid crystal displays (LCDs), both passive and active matrix, electroluminescent displays (ELDs), plasma display panels (PDPs), and vacuum fluorescent displays (VFDs). While such flat panel displays have inherently superior packaging, the CRT still has optical characteristics that are superior to most observers. Each of these flat panel display technologies has its unique set of advantages and disadvantages, as will be briefly described.

The passive matrix liquid crystal display (PM-LCD) was one of the first commercially viable flat panel technologies, and is characterized by a low manufacturing cost and good x-y addressability. Essentially, the PM-LCD is a spatially addressable light filter that selectively polarizes light to provide a viewable image. The light source may be reflected ambient light, which results in low brightness and poor color control, or back lighting can be used, resulting in higher manufacturing costs, added bulk, and higher power consumption. PM-LCDs generally have comparatively slow response times, narrow viewing angles, a restricted dynamic range for color and gray scales, and sensitivity to pressure and ambient temperatures. Another issue is operating efficiency, given that at least half of the source light is generally lost in the basic polarization process, even before any filtering takes place. When back lighting is provided, the display continuously uses power at the maximum rate while the display is on.

Active matrix liquid crystal displays (AM-LCDs) are currently the technology of choice for portable computing applications. AM-LCDs are characterized by having one or more transistors at each of the display's pixel locations to increase the dynamic range of color and gray scales at each addressable point, and to provide for faster response times and refresh rates. Otherwise, AM-LCDs generally have the same disadvantages as PM-LCDs. In addition, if any AM-LCD transistors fail, the associated display pixels become inoperative. Particularly in the case of larger high resolution AM-LCDs, yield problems contribute to a very high manufacturing cost.

AM-LCDs are currently in widespread use in laptop computers and camcorder and camera displays, not because of superior technology, but because alternative low cost, efficient and bright flat panel displays are not yet available. The back lighted color AM-LCD is only about 3 to 5% efficient. The real niche for LCDs lies in watches, calculators and reflective displays. It is by no means a low cost and efficient display when it comes to high brightness full color applications.

Electroluminescent displays (ELDs) differ from LCDs in that they are not light filters. Instead, they create light from the excitation of phosphor dots using an electric field typically provided in the form of an applied AC voltage. An ELD generally consists of a thin-film electroluminescent phosphor layer sandwiched between transparent dielectric layers and a matrix of row and column electrodes on a glass substrate. The voltage is applied across an addressed phosphor dot until the phosphor "breaks down" electrically and becomes conductive. The resulting "hot" electrons resulting from this breakdown current excite the phosphor into emitting light.

ELDs are well suited for military applications since they generally provide good brightness and contrast, a very wide viewing angle, and a low sensitivity to shock and ambient temperature variations. Drawbacks are that ELDs are highly capacitive, which limits response times and refresh rates, and that obtaining a high dynamic range in brightness and gray scales is fundamentally difficult. ELDs are also not very efficient, particularly in the blue light region, which requires rather high energy "hot" electrons for light emissions. In an ELD, electron energies can be controlled only by controlling the current that flows after the phosphor is excited. A full color ELD having adequate brightness would require a tailoring of electron energy distributions to match the different phosphor excitation states that exist, which is a concept that remains to be demonstrated.

Plasma display panels (PDPs) create light through the excitation of a gaseous medium such as neon sandwiched between two plates patterned with conductors for x-y addressability. As with ELDs, the only way to control excitation energies is by controlling the current that flows after the excitation medium breakdown. DC as well as AC voltages can be used to drive the displays, although AC driven PDPs exhibit better properties. The emitted light can be viewed directly, as is the case with the red-orange PDP family. If significant UV is emitted, it can be used to excite phosphors for a full color display in which a phosphor pattern is applied to the surface of one of the encapsulating plates. Because there is nothing to upwardly limit the size of a PDP, the technology is seen as promising for large screen television or EOWV applications. Drawbacks are that the minimum pixel size is limited in a PDP, given the minimum volume requirement of gas needed for sufficient brightness, and that the spatial resolution is limited based on the pixels being three-dimensional and their light output being omnidirectional. A limited dynamic range and "cross talk" between neighboring pixels are associated issues.

Vacuum fluorescent displays (VFDs), like CRTs, use cathodoluminescence, vacuum phosphors, and thermionic cathodes. Unlike CRTs, to emit electrons a VFb cathode comprises a series of hot wires, in effect a virtual large area cathode, as opposed to the single electron gun used in a CRT. Emitted electrons can be accelerated through, or repelled from, a series of x and y addressable grids stacked one on top of the other to create a three dimensional addressing scheme. Character-based VFDs are very inexpensive and widely used in radios, microwave ovens, and automotive dashboard instrumentation. These displays typically use low voltage ZnO phosphors that have significant output and acceptable efficiency using 10 volt excitation.

A drawback to such VFDs is that low voltage phosphors are under development but do not currently exist to provide the spectrum required for a full color display. The color vacuum phosphors developed for the high-voltage CRT market are sulfur based. When electrons strike these sulfur based phosphors, a small quantity of the phosphor decomposes, shortening the phosphor lifetimes and creating sulfur bearing gases that can poison the thermionic cathodes used in a VFD. Further, the VH) thermionic cathodes generally have emission current densities that are not sufficient for use in high brightness flat panel displays with high voltage phosphors. Another and more general drawback is that the entire electron source must be left on all the time while the display is activated, resulting in low power efficiencies particularly in large area VFDS.

Against this background, field emission displays (FDs) potentially offer great promise as an alternative flat panel technology, with advantages which would include low cost of manufacturing as well as the superior optical characteristics generally associated with the traditional CRT technology. Like CRTs, FEDs are phosphor based and rely on cathodoluminescence as a principle of operation.

Unlike CRTs, FEDs rely on electric field or voltage induced, rather than temperature induced, emissions to excite the phosphors by electron bombardment. To produce these emissions, FEDs have generally used a multiplicity of x-y addressable cold cathode emitters. There are a variety of designs such as point emitters (also called cone, microtip or "Spindt" emitters), wedge emitters, thin film amorphic diamond emitters or thin film edge emitters, in which requisite electric fields can be achieved at lower voltage levels.

Each FED emitter is typically a miniature electron gun of micron dimensions. When a sufficient voltage is applied between the emitter tip or edge and an adjacent gate, electrons are emitted from the emitter. The emitters are biased as cathodes within the device and emitted electrons are then accelerated to bombard a phosphor generally applied to an anode surface. Generally, the anode is a transparent electrically conductive layer such as indium tin oxide (ITO) applied to the inside surface of a faceplate, as in a CRT, although other designs have been reported. For example, phosphors have been applied to an insulative substrate adjacent the gate electrodes which form apertures encircling microtip emitter points. Emitted electrons move upwardly through the apertures and strike phosphor areas.

FEDs are generally energy efficient since they are electrostatic devices that require no heat or energy when they are off. When they operate, nearly all of the emitted electron energy is dissipated on phosphor bombardment and the creation of emitted unfnltered visible light. Both the number of exciting electrons (the current) and the exciting electron energy (the voltage) can be independently adjusted for maximum power and light output efficiency. FEDs have the further advantage of a highly nonlinear current-voltage field emission characteristic, which permits direct x-y addressability without the need of a trnisor at each pixel. Also, each pixel can be operated by its own array of FED emitters activated in parallel to minimize electronic noise and provide redundancy, so that if one emitter fags the pixel still operates satisfactorily. Another advantage of FED structures is their inherently low emitter capacitance, allowing for fast response times and refresh rates. Field emitter arrays are in effect, instantaneous response, high spatial resolution, x-y addressable, area-distributed electron sources unlike those in other flat panel display designs.

As described in pending parent application U.S. Ser. No. 08/852,228, ified May 6, 1997, the FED device has been improved to provide for a high-brightness field emission display with improved operating characteristics and durability. Phosphor biasing, electron emission amplification, and nitride barrier layers will contribute to the reduction of emitter to phosphor gap and vacuum requirements, while permitting a wider range of operating voltages as may be more efficient or otherwise desirable for improved brightness levels. Contamination control is also provided to extend emitter life and ion blocking is further used to extend the phosphor life.

While the FED technology holds out many promises, existing designs are not without drawbacks. Extensive research and development has been devoted to FEDs in recent years, and yet problems remain unsolved. It was against this background that the present invention has been conceived.

OBJECTS OF THE INVENTION

It is accordingly an object of this invention to provide a low cost, high efficiency field emission display having the superior optical characteristics generally associated with the traditional CRT technology, in the form of a digital device with flat panel packaging.

Another object of the invention is to provide a field emission display device, for either monochrome or full color applications, with improved light conversion efficiencies, and with greater cathode to anode voltage level flexibility.

Another object of the invention is a field emission display device using an improved cathode emitter made from a radioactive material resulting in an easier and cheaper manufacturing process for the device.

Another object of the invention is a field emission display device with improved light conversion efficiencies and in which requirements for an emitter to phosphor gap or an internal vacuum is reduced, in the case of an all-film emitter device structure.

Another object of the invention is a field emission display device in which a plurality of electron multiplier structures provide for a single pixel.

Another object of the invention is a field emission display in which a plurality of electron multiplier structures allow for an increased emitting area to minimize the effects of phosphor lumination caused by edges of conventional cathode emitters.

Another object of the invention is a field emission display in which an improved electron multiplier structure decreases cathode emitter tip erosion.

Another object of the invention is a field emission display in which an improved electron multiplier structure generates additional secondary electron emission from exposed surface edges of insulating layers.

SUMMARY OF THE INVENTION

The invention applies generally to field emission display devices which use cathodoluminescence of a light emitting layer as a principle of operation. In such devices, a field emitter cathode matrix may be opposed by a phosphorcoated, transparent faceplate that serves as an anode and has a positive voltage relative to the emitter array matrix. The devices will typically incorporate a transparent conductive layer such as indium tin oxide (ITO) applied to the inside surface of the faceplate, or between the faceplate and the phosphor coating, to provide the anode electrode for applicable biasing with respect to the cathode emitters. The ITO and the phosphor coating may be masked or patterned on the faceplate to provide a matrix of x-y addressable pixels, with addressing provided via a selective cathode-emitter activation. The devices may use high voltage sulfur-based phosphors, or low voltage phosphors may also be used. Smooth deposited phosphor films on the order of about 1200 Angstroms in thickness are presently preferred for use with this invention, for improved light transmission.

In accordance with one aspect of the invention, an electron multiplier structure is used to generate secondary electron emissions. A plurality of electron multiplier structures may correspond to a single pixel in a FED device, as well as allow for an increased emitting area to minimize the effects of phosphor lumination caused by edges of conventional cathode emitters. Moreover, the use of the narrow channel structures reduces the possibility that a returning ion will strike an emitter, and thus decrease cathode emitter tip erosion.

The above-mentioned and other objects, features and advantages of the invention will become apparent from the further descriptions and the attached drawings.

DETAILED DESCRIPTION OF THE PRESENTLY PREFERRED EMBODIMENTS

Figure 1:
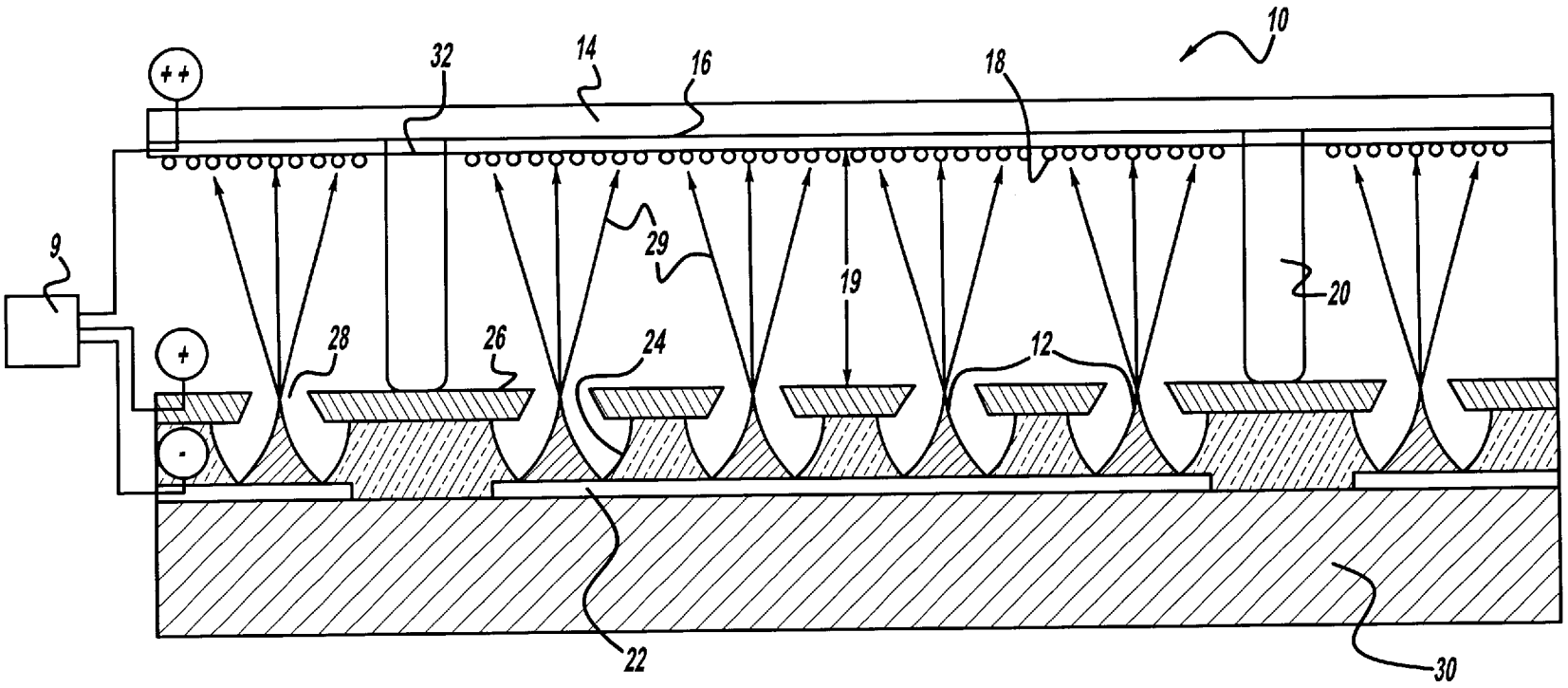
Figure - 1 (Prior Art)
FIG. 1 is a cross sectional schematic view of an exemplary field emission display device within the prior art.

FIG. 1 schematically depicts an exemplary field emission display (FED) device 10 found within the prior art. This flat panel display comprises an x-y electrically addressable matrix of cold-cathode microtip or "Spindt" type field emitters 12 opposing a faceplate 14 coated with a transparent conductor layer 16 and a phosphor light emissive layer 18. A distance or gap 19, generally on the order of 100 to 200 $\mu$m, is maintained between the emitters 12 and the phosphors 18 by spacers 20. The volume of space between the emitters 12 and the phosphors 18 is evacuated to provide a vacuum environment with a pressure generally in the range of $10^{-5}$ to $10^{-7}$ Torr. This environment is generally gettered (by means not illustrated) to mitigate against contamination of the internal parts, and to maintain the vacuum.

As illustrated, each emitter 12 has the shape of a cone and is coupled at its base to an addressable emitter electrode conductor strip or layer 22, through which the emitter 12 is biased as a cathode having a negative voltage, via power supply 9, with respect to the conductor 16 which serves as the anode. Adjacent conductor strips 22 are electrically separated by extensions of a dielectric insulator structure 24 that also separates adjacent emitters 12. A conductive electron extraction grid 26 is positively biased as a gate electrode with respect to the emitters 12, and has apertures 28 through which emitted electrons 29 have a path from the emitters 12 to the phosphors 18. The extraction grid 26 can be an addressable strip, orthogonal to the conductors 22, for servicing a row or column of matrix groups of emitters 12. In that case there would typically be a multiplicity of orthogonal extraction grids 26 and conductor strips used within the FED 10. As shown, the extraction grid 26 is spaced and electrically isolated from the conductors 22 by the insulator structure 24. The emitters 12 and the conductors 22 are formed on a substrate or base plate 30.

When the FED 10 is operational, a group of emitters 12 is addressed and activated by application of a gate potential, usually on the order of about 15 to 50 volts, between the associated cathode electrode strip 22 and extraction grid 26. With the resulting primary field emission of electrons from the emitters 12, the emitted electrons are accelerated toward the anode conductor layer 16 to bombard the intervening phosphors 18. The phosphors 18 are induced into cathodoluminescence by the bombarding electrons, emitting light through the faceplate 14 for observation by a viewer. The operational potential between the cathode electrode strip 22 and the anode conductor layer 16 at the faceplate 14 is generally on the order of 500 to 1000 volts for FEDs using high-voltage, sulfur-based phosphors.

As illustrated in FIG. 1, the phosphors 18 may be optionally patterned on the faceplate 14 with conventional black matrix separations 32 to better define dots or discrete pixel areas which may be digitally addressed and illuminated on the FED 10. As shown, each pixel may be serviced by its own matrix or multiplicity of emitters 12 to provide redundancy in the event one or more of the emitters 12 prove inoperative.

By miniaturizing the size of the emitters 12, modest voltages can cause electrons to emit out of the cone tips very efficiently, without heat. For this reason, these and operationally similar field emitters are often called "cold cathode" emitters. "Spindt" type emitters 12 are typically sized with cone heights on the order of about 1 $\mu$m, and pitched at about 10 microns or less, allowing packing densities on the order of about $10^6$ emitters per $cm^2$. Apertures 28 are typically sized with diameters on the order of 1 $\mu$m.

The illustrated field emitter structure, comprising the emitters 12, the conductor strips 22, the insulator structure 24, and the extraction grid 26, can generally be made at low cost for small size displays using semiconductor microfabrication technology. For example, the emitters 12 can be formed on the conductor strips 22 on a silicon substrate 30 and overlaid by sequential depositions of a layer of silicon dioxide and a conductive metal gate film for the insulator structure 24 and the extraction grid 26. Resulting raised areas over the emitters 12 can be removed by polishing, and the silicon dioxide dielectric immediately surrounding the emitters 12 can be removed by wet chemical etching to define self-aligned apertures 28, as is well known. This process becomes very difficult to manufacture as display size increases.

FIG. 1 is not drawn to scale, as a typical FED of the type illustrated would generally have 100 or more of the emitters 12 for servicing of each pixel area on the display.

Figure 2:
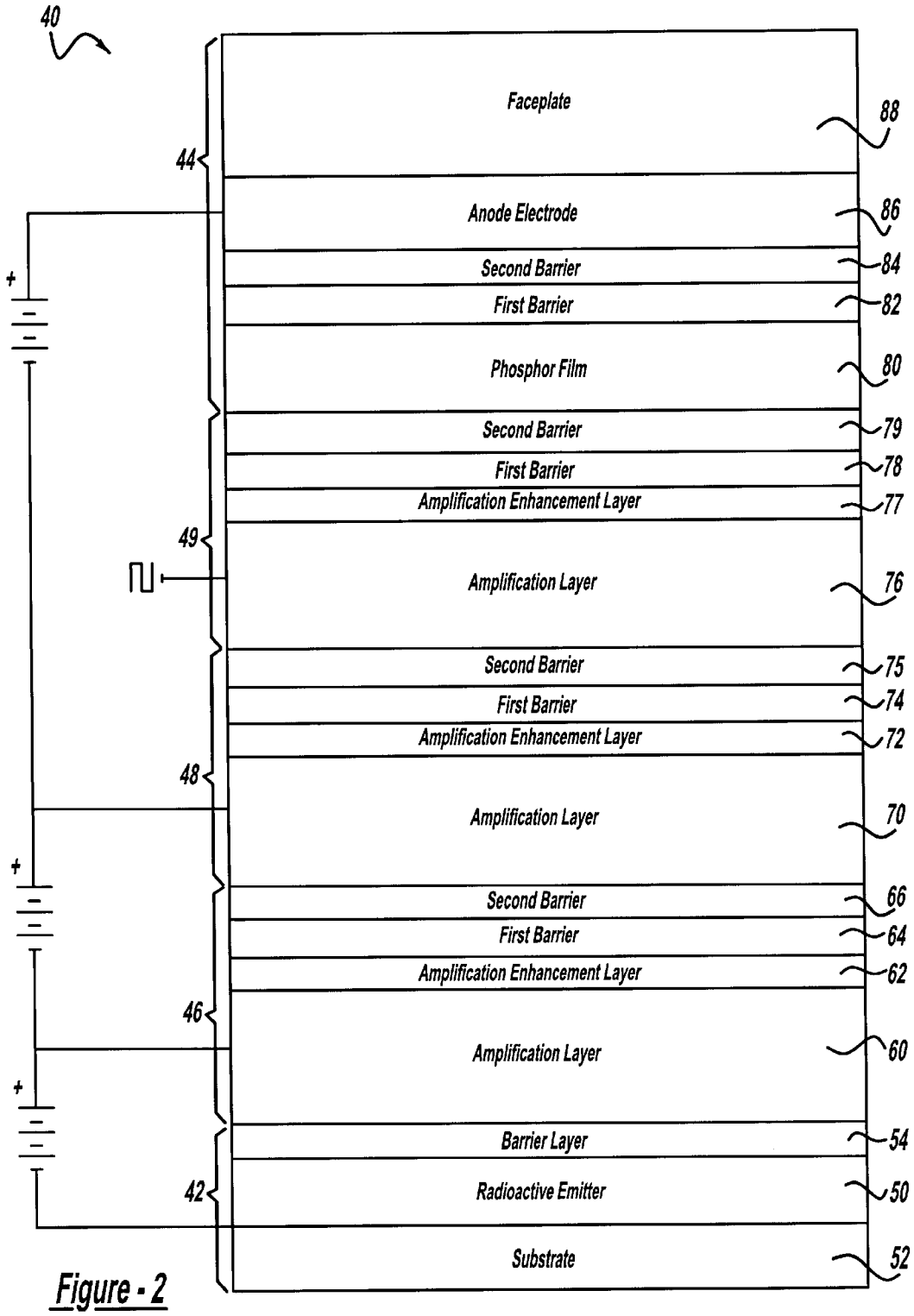
FIG. 2 is a cross sectional schematic view of an exemplary "all-film" field emission display device implementing a radioactive emitter.

FIG. 2 schematically illustrate the presently preferred embodiments of the invention with features which can be readily adapted to the type of FED device 10 shown in FIG. 1, as well as to other types of field emission display devices with other types of field emitters not illustrated. Referring to FIG. 2, this figure depicts exemplary film layering for an "all-film" FED device 40 having a cathode emitter stage 42, a light emitting stage 44, two amplification stages 46 and 48 and a gate controlled amplification stage 49. The emitter stage 42 comprises a radioactive emitter 50 constructed using radioactive material (e.g. 5,000 Angstroms thick layer) applied to a molybdenum substrate 52 and electronically coupled as a cathode. The radioactive material may include tritium ($H_3$), e.g., in the form of tritided scandium or titanium. It is also envisioned that the radioactive material may include amorphous silicon reacted with a silane doped with tritium. A radioactive emitter 50 will have a long half-life in the range of 12½ years and decays with a relatively constant, low-level release of negative beta particles (electrons) over the projected product life of the FED device 40. While a single emitter is schematically illustrated for servicing of a single display pixel location, it will be understood that a matrix or multiplicity of cathode emitters may be used, such as was previously described with reference to FIG. 1.

Since the radioactive emitter 50 is continuously "on", the associated primary electron emissions must be at a sufficiently low level that they do not significantly penetrate to the phosphors when the device is "off". For example, material with radioactivity levels at least 100 millicuries per square centimeter, comparable to those low levels of radioactivity found in some compasses, watches and other similar devices, can be used to produce primary electron emissions with energy levels on the order of 5.7 kev. To activate the phosphors, the FED device 40 uses one or more stages of amplification and applied electronic fields to produce secondary electron emissions having higher requisite energy levels.

A barrier layer 54 comprised of a thin film of insulator material, preferably silicon nitride, may be disposed between the radioactive emitter 50 and the first amplification stage 46. The barrier layer 54 will generally be disposed directly on the anode side of the cathode emitter 50 as shown. Preferably, this is a thin silicon nitride layer applied directly on the radioactive emitter 50, thin enough to permit the tunneling of electrons (on the order of 30–40 Angstroms thick). It is important to appreciate that silicon nitride is an effective blocker of ions, and that electron tunneling is exhibited in sufficiently thin films of silicon nitride.

Amplification stages, 46 and 48, may include multiple film layers interposed between the emitter stage 42 and the light emitting stage 44. Generally, amplification stages comprise an amplification material having a high amplification factor, for producing secondary emissions of electrons when bombarded by primary emissions of electrons from the cathode emitter. By way of example, the amplification factor for copper-beryllium is estimated to be approximately 4 to 6. This means that when bombarded with electrons of sufficient energy, for each electron reaching the copper-berylium target, there will be 4 to 6 electrons emitted. (On this scale, the secondary emission amplification factors for most metals are less than two.) Silver-magnesium (e.g., Ag-Mg) films are similar to those of copper-beryllium. In the FED device 40 as shown in FIG. 2, primary electrons will bombard and enter the amplification stages from the side of the cathode emitter 50, generating secondary electron emissions internally or on the side of the light emitting stage 44. Presently preferred amplification materials include slighty oxidized films of copper-barium, copper-beryllium, gold-barium, silver-magnesium or tungsten-barium-gold. Also, gold calcium would be a particularly effective amplification material to use, although its amplification properties may not have been heretofore well appreciated. It is also envisioned that rubidium antimony or other alkali compounds may be used as material for the amplification layers.

To achieve enhanced secondary electron emissions within the FED device 40, an amplification enhancement layer or film 62 and 72 can be disposed on the light emitting stage side of the amplification layer 60 and 70. Preferably, the amplification enhancement layer 62 and 72 will be a near mono-molecular layer, and will generally be applied directly over top of the amplification layer 60 and 70, respectively. The material for amplification enhancement layer 62 and 72 is preferred to consist essentially of an oxide of barium, beryllium, calcium, magnesium or strontium. Preferred combinations of amplification layers and amplification enhancement layers include magnesium oxide 62 or 72 in association with an Ag—Mg layer 60 or 70, a beryllium oxide 62 or 72 in association with a Cu—Be layer 60 or 70, or a calcium oxide layer 62 or 72 in association with a gold-calcium layer 60 or 70. Lastly, a copper-beryllium layer 60 or 70 overlaid on the light emitting stage side by a near mono-molecular layer 62 or 72 of magnesium oxide or beryllium oxide would also help increase secondary emissions as described herein. Amplification enhancement layers are generally less than 10 Angstroms in thickness.

The amplification layer 60 and 70, and amplification enhancement layer 62 and 72 may be deposited by conventional sputtering from a conditioned alloy target or, for example, by a cosputtering process. To illustrate, a lightly oxidized beryllium target may be prepared by moving a target from room-temperature, ambient conditions to an oven at about 250° C. for about 30 minutes, converting the exposed beryllium surface to Be—O. The resulting lightly oxidized target can then be introduced along with a second, copper target for use within a sputtering chamber which is evacuated and back-filled with argon to a pressure of approximately one to ten microns. By sputtering initialy from the beryllium target only, a near mono-molecular beryllium oxide layer may be deposited. By then co-sputtering from the beryllium and copper targets simultaneously, a copper-beryllium layer can then be deposited to a thickness of approximately 120 Angstroms, which will contain a small amount of Beryium oxide.

Additional dielectric barrier films may also be applied to a light emitting side of either an amplification layer 60 or an enhanced amplification layer 62. These thin barrier films will increase the electron excitation voltages and ihibit current flow until a sufficiently high electric field is present. A first barrier film 64 and 74 is preferably comprised of silicon nitride or other similar dielectric material. A second (optional) additional intrinsic amorphous silicon (α-silicon) film 66 and 70 may also be interposed on the light e side of either amplification layer.

Adjacent the emitter stage 42 is a first amplification stage 46 comprising a amplification layer 60 of silver magnesium overlaid by an amplification enhancement layer 62 of magnesium oxide. A silicon nitride barrier layer 64 and second (optional) α-silicon barrier layer 66, each on the order of 30–40 Angstroms thick, are shown deposited over the amplification enhancement layer 62. A second amplification stage 48 having essentially the same film structure as the first amplification stage 46 is interposed between the first amplification stage 46 and the phosphor layer 80. In addition, a gate controlled amplification stage 49 also having essentially the same film structure as the first amplification stage 46 is then interposed between the the second amplification layer and the phospher layer 80. This stage controls the number of electrons exciting the phosphor layer 80. The gate input signal is applied to the amplification layer 76 of the gate controlled amplification stage 49. When this signal is negative, electrons are repelled and unable to reach the phosphor film layer 80. The gating action is similar to gating in a CRT. As will be apparent to one skilled in the art, two or more amplification stages can be incorporated into the FED device.

The light emitting stage 44 includes a light emitting layer 80, an anode electrode layer 86, a faceplate 88, and additional barrier layers, 82 and 84. The light emitting layer 80 preferably has a thickness on the order of about 1200 Angstroms, and preferably comprises smooth deposited phosphors that can be applied by atomic layer epitaxy (ALE) or by the vapor reaction technique taught by Cusano and Studer in U.S. Pat. No. 2,685,530. Phosphors such as $Y^2O^3:Eu^{3+}$ can be used, as can other cathodoluminescent phosphors such as oxide type (e.g., ZnO:Zn) or sulfur-based cathodoluminescent phosphors. The best thickness for a phosphor layer depends upon the conductivity of the phosphors. Generally, phosphor field strengths are preferred to be in excess of $5\times10^4$ volts/centimeter. Because of the high field strengths involved with electron tunneling, use of phosphor powders is not presently preferred. One of the reasons for this is related to the packing density of phosphors. Spherical phosphor particles pack more densely than polyhedral particles and would be the phosphor particle of choice. However, conventional commercially available phosphor powders generally have a polyhedral makeup. Preferably, the light emitting layer 80 will be masked or patterned as dots or otherwise on the faceplate 88 to provide a matrix of discrete pixel areas, with addressing provided via a selective cathode-emitter area activation.

As further shown in FIG. 2, the light emitting stage 44 may also incorporate a barrier layer 82 of a thin film of insulator material, preferably silicon nitride, disposed between the faceplate 88 and the fight emitting layer 80. The barrier layer 80 will generally be disposed directly on the anode side of the light emitting layer 80. The barrier layer 82 functions to inhibit ion flow, migrations or depositions of anode material on or into light emitting layer 80. Preferably, this is a thin silicon nitride layer that is thin enough to permit the tunneling of electrons but thick enough to inhibit the flow of ions by way of anode plating action into the phosphor when the device is activated. In addition, a second (optional) barrier layer 84 of a similar insulating material may also overlay the first barrier layer.

What may not be appreciated is the effect that such plating action may have on phosphor poisoning and lifetime degradations in a field emission display. Thus, the need for nitride barrier layer 82.

A further advantage of the barrier layers 82 and 84 results from the tunneling characteristics of the nitride material, to enhance the non-linearity and luminous efficiency of the FED device 40. Cathodoluminescent phosphors are generally very efficient under high accelerating voltages as compared to phosphors excited at low accelerating voltages. In fact, luminescence can for the most part disappear when the excitation voltage drops below a "dead voltage", which can be as high as about 1500 volts for high voltage phosphors in conventional devices. This occurs because of a dead surface layer on the phosphors and charge build-up. What is important to realize is that there must be good electron penetration into the phosphor material to achieve good luminous efficiency. When phosphors are excited at low voltages, the current may be high but penetration is low, resulting in poor luminous efficiency.

With one or more barrier layers, the phosphor excitation voltage is effectively increased until tunneling occurs and the barrier layers 82 and 84 become conductive via tunneling. This increase in excitation voltage—prohibiting current flow until a high field is present—results in higher electron penetration into the light emitting layer 80 and increased phosphor efficiencies. Thus, barrier layers 82 and 84 each contribute to high brightness cathodoluminescence with improved light conversion efficiencies and phosphor lifetimes within a FED device 40.

Chemical vapor deposition (CVD) and sputtering are two well known and acceptable techniques for the deposition of the barrier layers 82 and 84, which are each to be deposited to a thickness on the order of about 30 to 40 Angstroms. For efficient electron tunneling through the barrier layers 82 and 84, and for voltage drops of less than 10 volts across each layer, their combined thickness should be less than about 100 Angstroms. If phosphor biasing is implemented, the bias voltage can be on the order of about 20 to 35 volts with the barrier layers 82 and 84 being within this thickness range. Field strengths across the nitride barrier layers 82 and 84 are preferably on the order of $10^6$ volts/centimeter for effective tunneling of electrons through the films.

While silicon nitride is the presently preferred material for barrier layer 82, other dielectric materials such as silicon dioxide, magnesium fluoride or polyimide materials (e.g., Kapton™ polyimide fnms) may also be useable. Also, a semiconductor material, such as amorphous or polysilicon, can be used for the barrier layer. Whatever dielectric or insulator material is used it is preferred that the layers 82 and 84 be dense as opposed to porous. Standard thermal evaporated material lms usually tend to be porous, while sputtered and CVD films are more dense and therefore preferred.

The faceplate 88 is generally transparent to allow transmission of emitted light from an inside surface of faceplate 88 to an outside surface of faceplate 88 for viewing. Electrical biasing of the faceplate 88 is accomplished by using an anode electrode 86 comprising a transparent layer of electrically conductive material, such as indium tin oxide (ITO), disposed between the inside surface of faceplate 88 and either (or both) first barrier layer 82 and second barrier layer 84. The thickness of each barrier layer 82 and 84 is between 30–40 angstroms. Preferably, the conductive layer will be deposited ITO on the inside surface of the faceplate 88, with a resistance of about 200 to 300 ohms per square, and a refractive index of less than 1.75, to permit at least 80% of directed emitted light to be transmitted through the anode electrode 86 and the faceplate 38. The anode electrode 86 may be continuous or it may be patterned, for example, such as by having addressable strips to implement a full color display as taught in U.S. Pat. No. 5,225,820.

In operation, low-level primary electron emissions continuously occur through the radioactive cathode emitter.

These in turn produce successively multiplied secondary electron emissions at higher energy levels by passing through the successive amplification stages, ultimately bombarding the phosphor layer with penetrating secondary electrons to produce emitted light for viewing through the face plate. A gating voltage 92 between the second amplification stage 48 and the light emitting stage 44 can be switched from negative to positive with respect to the emitter 50 or with respect to the second amplification stage 48 as a way to provide gating or selective activation and deactivation of phosphor pixel areas within the FED device. In this way, the amplification stage 49 serves as the gating layer of the device.

Figure 3:
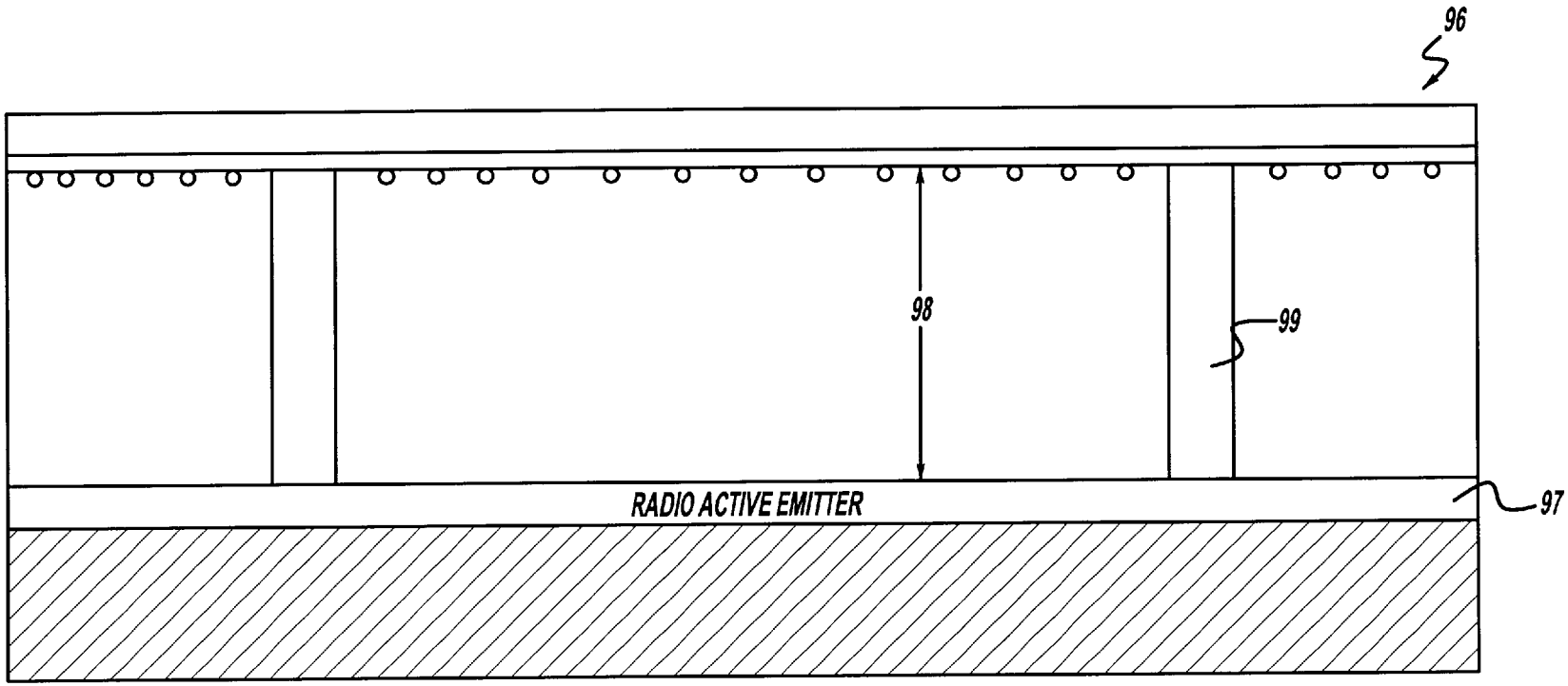
FIG. 3 is a cross sectional schematic view of an exemplary field emission display device implementing a radioactive emitter with conventional emitter to phosphor spacing.

Although an "all-film" FED device using a radioactive emitter may reduce emitter to phosphor spacing and eliminate associated vacuums, FIG. 3 shows an embodiment employing a more conventional device structure. As shown in FIG. 3, a radioactive emitter (as discussed above) serves as the primary electron source. A distance or gap 98 of less than 100 $\mu$m is maintained between the emitter and the phosphors by spacers 99. An internal working vacuum better than $10^{-5}$ Torr, and an emitter-cathode to anode working potential less than 500 volts (for high voltage phosphors) may also be desired. One skilled in the art will recognize that this embodiment will otherwise have the same construction using the same process as a conventional FED device.

Figure 4:
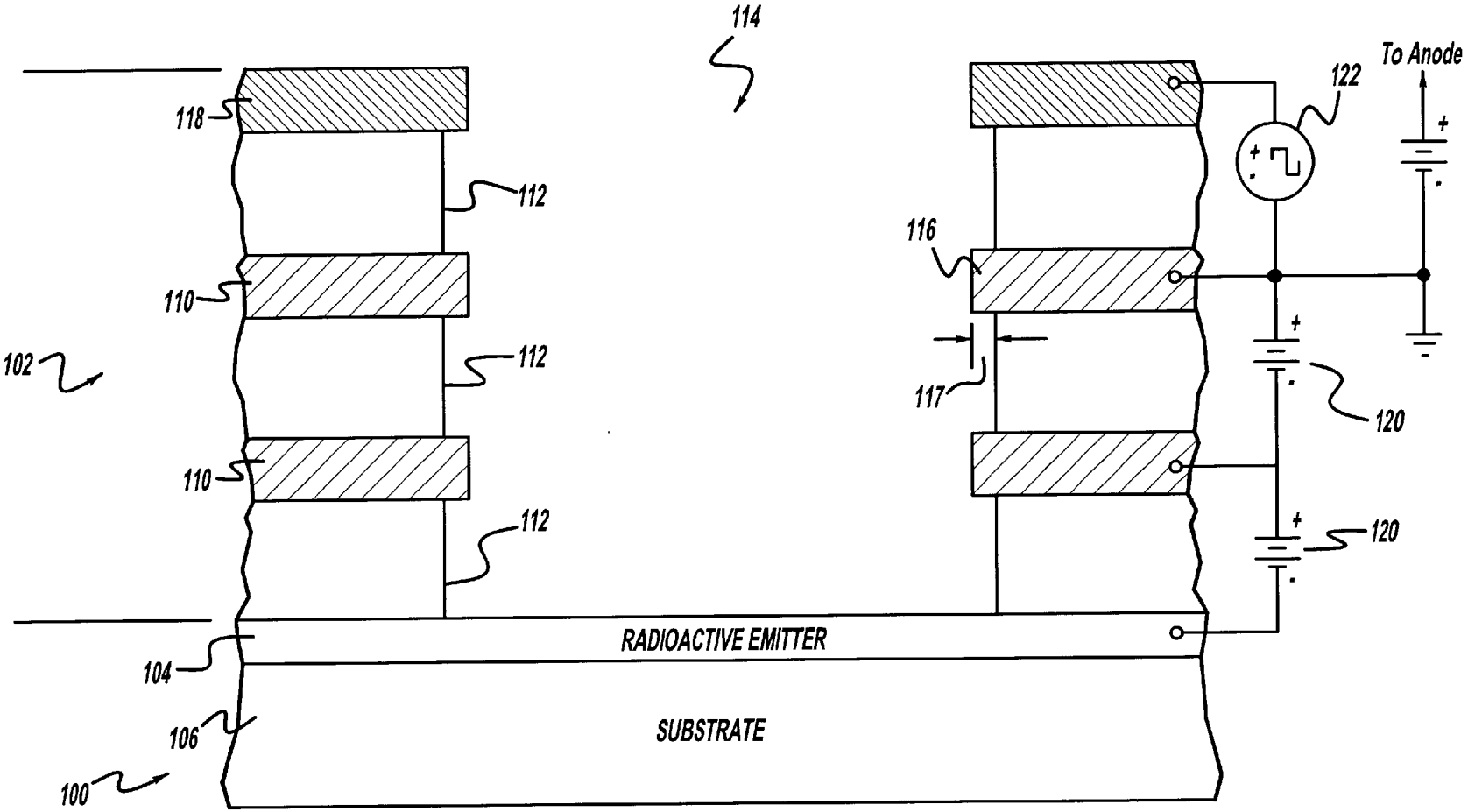
FIG. 4 is a cross sectional schematic view of an exemplary field emission display device implementing an electron multiplier structure in conjunction with a radioactive emitter.

An alternative embodiment of the present invention is seen in FIG. 4. An electron multiplier structure 102 is shown in conjunction with a field emission display device 100. Although the electron multiplier 102 has been depicted in the context of a FED device 100, the following description is intended to adequately teach one skilled in the art to make a similar electron multiplier for use in a variety of situations. Referring to FIG. 4, the cathode emitter 104 for providing primary electron emissions is constructed using a radioactive material (as discussed above). This radioactive emitter 104 is constructed by depositing a thin film of scandium or titanium onto a substrate 106. Next, an amplification stage can be deposited onto the cathode emitter 104. An amplification stage includes thin dynode layers 110 sandwiched between thin insulating layers 112. Multiple layers, alternating between dynode layers 110 and insulating layers 112, can be added to the amplification stage until achieving the desired amplification ratio for producing amplified secondary emission of electrons. Si r to the amplification layers previously discussed, dynode layers 110 comprise amplification materials having a high amplification factor with a thickness on the order of 3,000 Angstroms. Insulating layers 112 with an approximate thickness of 5,000 Angstroms are comprised of silicon nitride or other dielectric material.

Numerous materials exhibit high secondary electron emission required for the dynode layer 110. Some of these materials have higher band gaps then what is commonly used in photomultiplier tubes. In this invention, materials with high band gaps are preferred because they are not as sensitive to fabrication problems as are low band gap materials, such as cesium or the other alkali's that are necessary for the visible light generation of electrons. One skilled in the art will recognize that due to migration problems, first cohmnm halides for use as dynode material should be chosen carefully. Although copper-berylium, magnesium, aluminum or other first column halides can be used, copper-beryllium will be discussed in this application. It is also envisioned that rubidiun antimony or other alkali compounds may be used as material for the dynode layer.

After the amplification stage has been deposited onto the cathode emitter layer 104, it is coated with photoresist and patterned by techniques known to those skilled in the art. An electron multiplier structure 102 is formed by etching a channel or cavity 114 into the multiple amplification stage layers. These layers are subjected to RIE (reactive ion etch) to delineate the pattern as shown in the cross sectional view of FIG. 4. The amplification protrusions 116 shown on the ends of the dynode layers 110 extending into the cavity 114 are formed by first etching through all of the layers via an anisotropic etch down to the cathode emitter layer 104. The etch must not erode this bottom (i.e., cathode emitter) layer. Standard procedures known by those skilled in the art provide a means for forming this type of etch step. Next, an isotropic etch selective to silicon nitride or other applicable insulating material is performed to etch laterally into each insulating layer 112, such that amplification protrusions 116 are formed extending into the cavity 114 of the electron multiplier structure 102. Amplification protrusion 116 extend a distance 117 on the order of 1,000 Angstroms into the cavity 114. While not essential to operation, these protrusions are desirable to raise efficiency.

Figure 5:
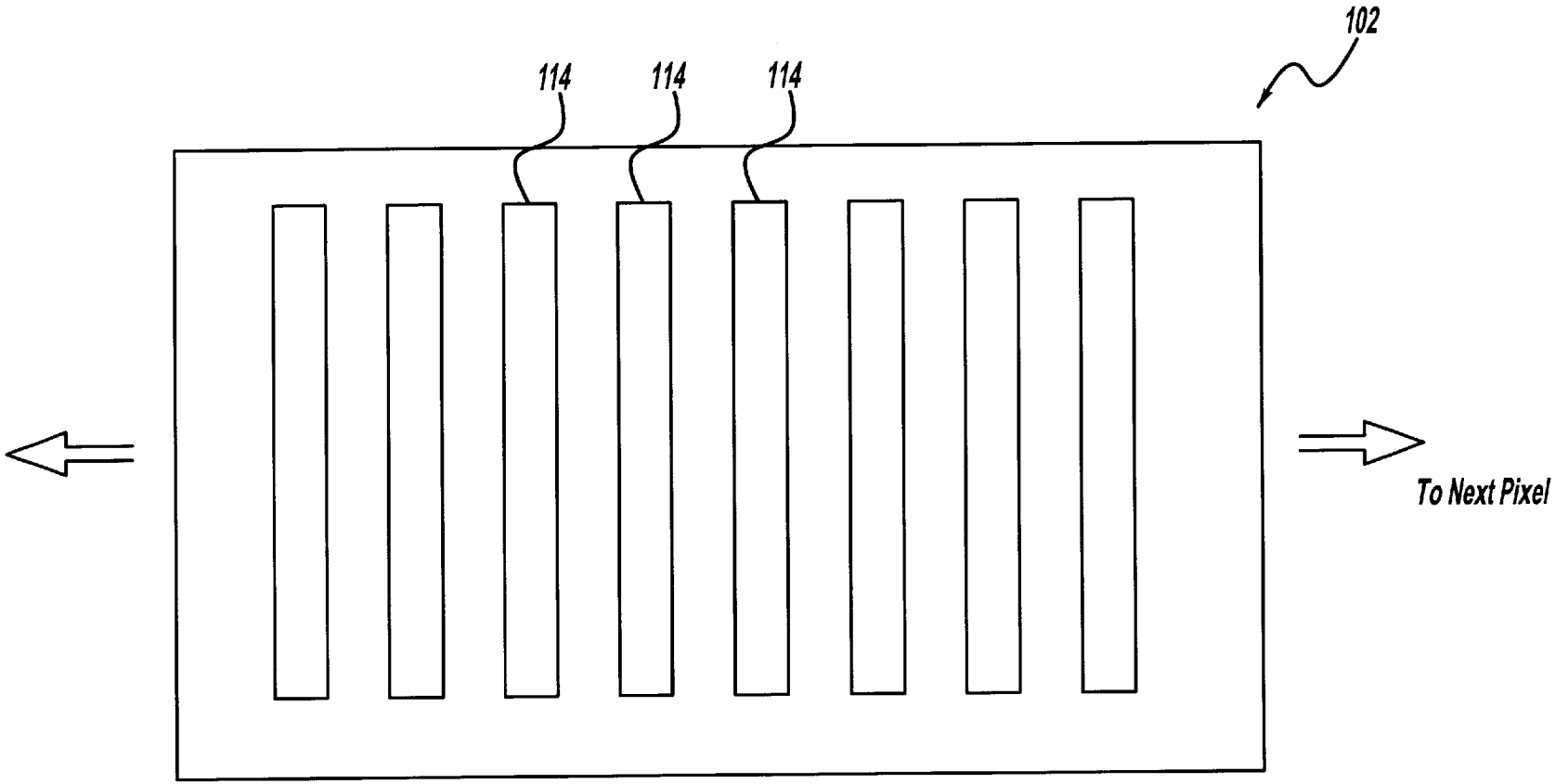
FIG. 5 is a top view of an exemplary field emission display device implementing a plurality of electron multiplier structures for use as a single pixel.

A top view of the electron multiplier structure 102, as seen in FIG. 5, shows each cavity 114 as a long narrow channels. A multiplicity of these cavities 114 are used for each pixel to reduce/eliminate strong edge phosphor illumination effects. In prior art emitters, a number of Spindt points or edge emitters are used for each pixel in generating a required number of electrons. As can be seen in FIG. 5, only one such electron multiplier structure 102 is required for each pixel.

At this point, the scandium or titanium film of a radioactive emitter 104 can be tritiated, if not already done so. After the cathode emitter 104 is tritiated, the exposed edge surface of amplification protrusions 116 are oxided for enhanced secondary electron emissions. The exposed edge surfaces are exposed to oxygen at approximately 150° C. for 10 minutes; this procedure will convert a small part of the copper-beryllium surface to oxide which is necessary for good secondary electron emission. Other materials can also be used such as magnesium which is oxidized to magnesium oxide or aluminum which is oxidized to aluminum oxide. Although these materials are not exciting for photo emission as required in a photomultiplier tube, they do serve as good secondary electron emitters when bombarded with primary electrons.

In operation, the electron multiplier 102 of the present invention is similar to a photomultiplier tube. Unlike the photomultiplier, the primary electrons in this embodiment are given off by a radioactive cathode emitter. Primary electrons from the cathode emitter are driven to the first dynode layer by an applied voltage source 120 coupled to electrically bias the cathode emitter with respect to the first dynode layer. Electrons striking the first dynode layer release more electrons as a result of secondary emission. With a secondary electron emission ratio of five, there will be five electrons liberated for each electron striking the first dynode layer. Because the voltage applied to the second dynode is positive with respect to the first dynode layer, the electrons will in turn be directed toward the second dynode layer. The number of amplified electrons generated is determined by the number of dynode layers multiplied by the secondary electron emission ratio.

Figure 6:
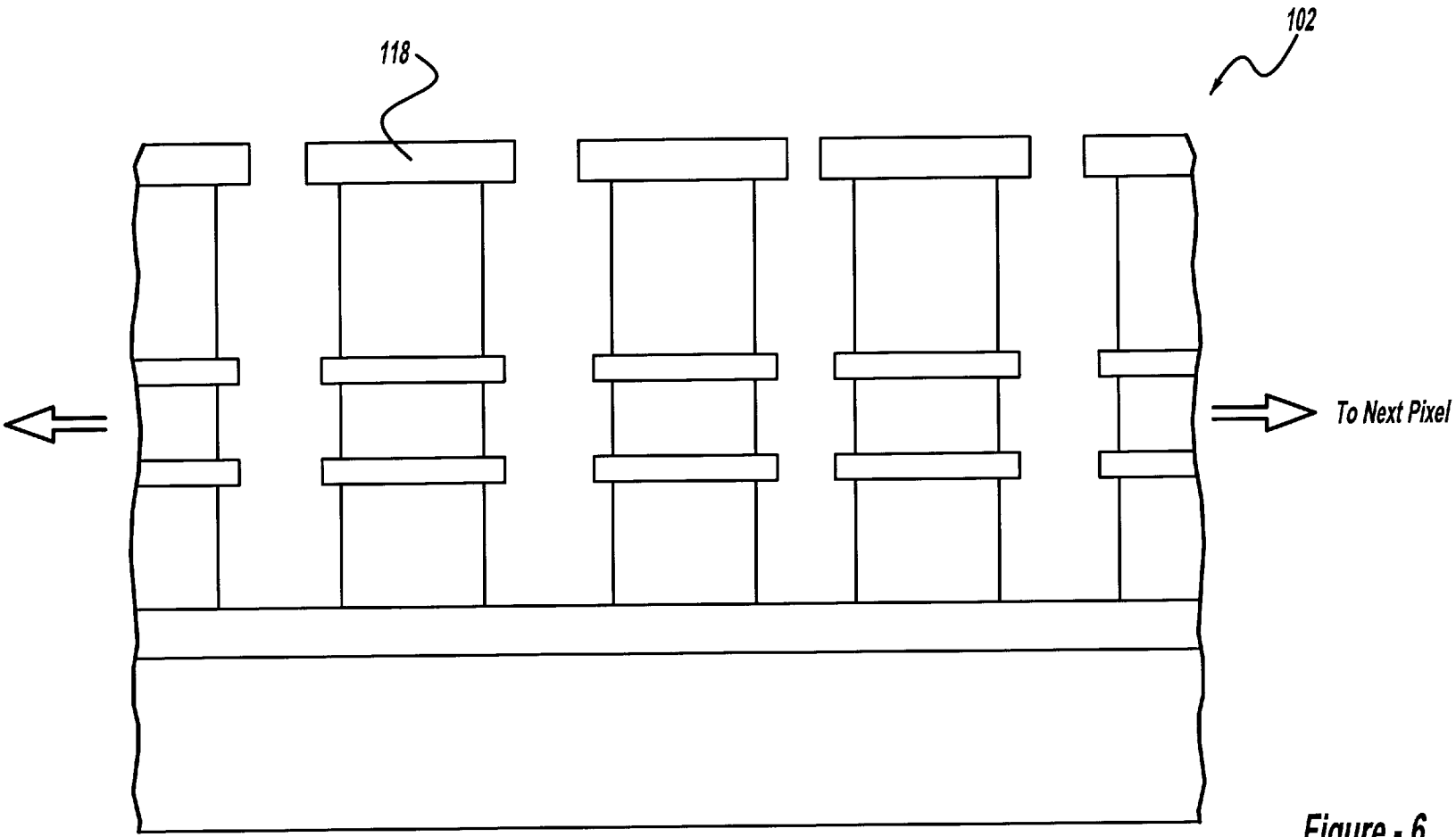
FIG. 6 is a side view of an exemplary field emission display device implementing a plurality of electron multiplier structures for use as a single pixel.

To facilitate the operation of the electron multiplier structure 102, a gate electrode 118 is shown in FIG. 4. Preferably, the gate electrode 118 will be comprised from Molybdenum or Tantalum. A gating voltage source 122 is interconnected between the gate electrode 118 and ground. One could also connect the input voltage 122 between the gate electrode 118 and second dynode electrode 116 with or without ground being connected to second dynode 116 or to the radioactive emitter 104. The gating voltage is modulated to control the number of electrons delivered to the light emitting layer (not shown). While this gating voltage is on the order of ten volts, it is dependent on the depth and spacing of the electron multiplier structure 102 along with deposited layer thicknesses. As will be apparent to one skilled in the art, the various configurations may be used to construct the light emitting layer (not shown) which overlays the gate electrode 118 to complete the field emission device 100. As best seen in FIG. 6, the gate electrode 118 is delineated in a pattern which is intended to reduce input capacitance.

In addition, the electron multiplier structure described in this application also acts partially like a channel electron multiplier (CEM) or a microchannel plate (MCP) as taught in U.S. Pat. No. 5,378,960. The dynode/insulator layering structure of this invention is comparable to the conductive (resistive) "tunnel" in a CEM device. However, the insulating layer 112, can also provide additional secondary emission effects. Although there is no conductive coating on the exposed edge surfaces of the silicon nitride, the mere presence of it being sandwiched between two conductors, creates a capacitive distribution of the applied voltage along its length. Therefore, the electron multiplier structure 102 of this invention benefits from secondary emission characteristics from the exposed edge surfaces of insulating layers 112.

Alternatively, secondary emissive material could be deposited via chemical vapor deposition (CVD) onto the entire inner surface of the sidewalls in the electron multiplier structure 102. In this manner, emissive material covering the exposed edge surfaces on the insulating layers 112 would be the same as material covering the dynode layers 110. There would be no electrical continuity between the dynode layers 110, rather a capacitive distribution would serve to boost electron amplification. The amount of electron amplification depends upon the ratio between the height of the sidewalls and the cavity opening width of the electron multiplier structure, such that the higher this ratio, the greater the amount of electron amplification.

Figure 7:
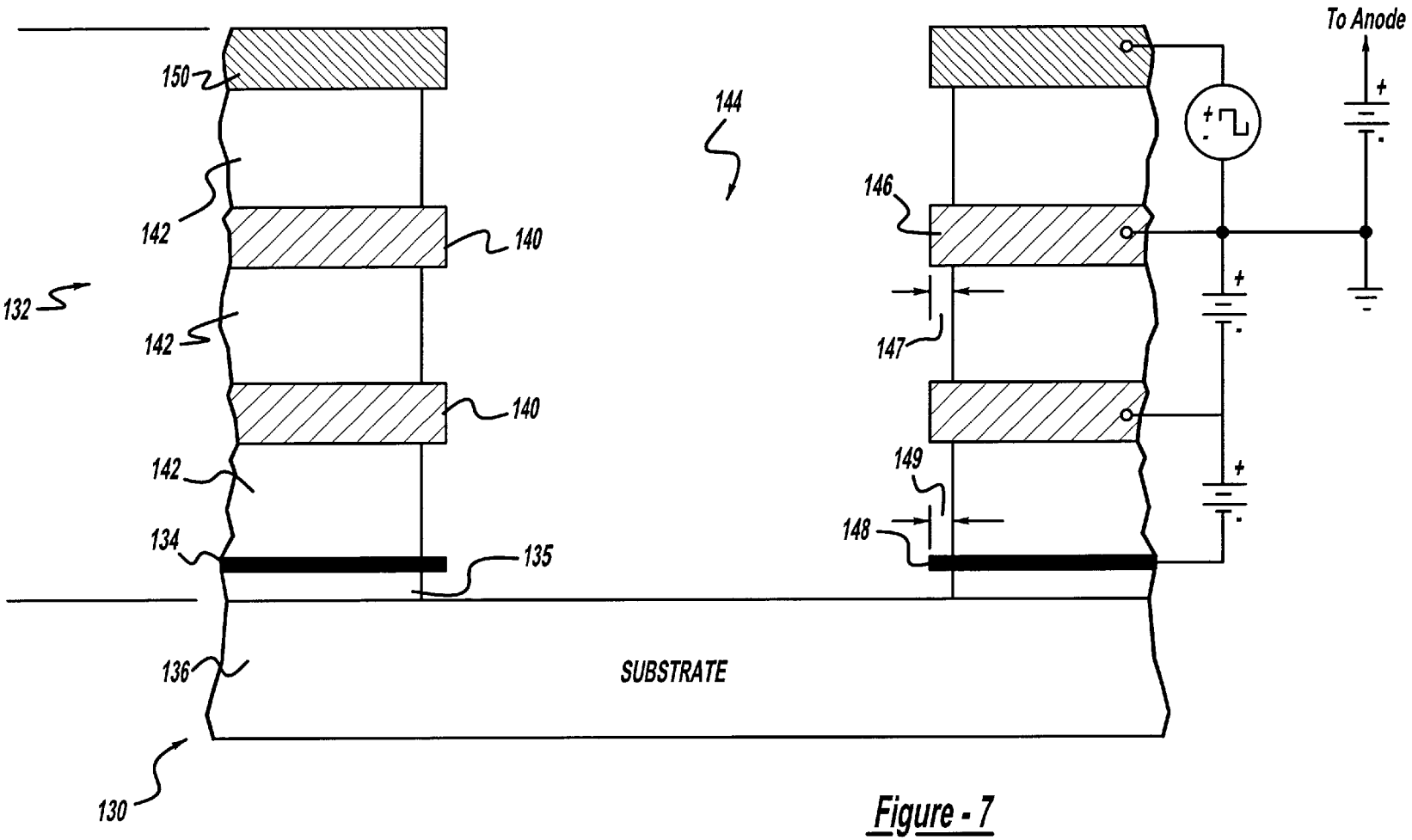
FIG. 7 is a cross sectional schematic view of an exemplary field emission display device implementing an electron multiplier structure in conjunction with an edge emitter.

Another embodiment of the electron multiplier structure 102 is in conjunction with electron edge type emitters. Rather than having electrons being released from a radioactive source, primary electrons are emitted from a point-like source, such as the edge of a thin film, as taught in U.S. Pat. No. 5,618,216. In FIG. 7, the edge emitter 134 is disposed between a substrate 136 and an insulating layer 142 of the electron multiplier structure 132. To facilitate the etching process, an (optional) silicon nitride layer 135 may be disposed between edge emitter 134 and substrate 136. The edge emitter 134 consists of a very thin conductive film protruding into the channel of the electron multiplier 132, preferably having a high melting point and a low work function. Although low work function materials are usually low melting point materials, hafnium and tantalum are a few high temperature materials that have also been found with low work functions. The emitting protrusions 148 formed on the end of the edge emitter layer 134 extend a distance 149 of approximately 1,000 Angstroms into the cavity 144. Similarly, the amplification protrusions 146 formed on the end of the dynode layers 140 extend into the cavity 144 a distance 147 on the order of 1,000 Angstroms. One skilled in the art will recognize that the edge emitter embodiment is constructed having the same characteristics, including a gate electrode layer 150, and using the same process as discussed for the embodiment shown in FIG. 4. Although not necessary, the protrusion increases efficiency.

As previously seen, when a high enough voltage is applied between the edge emitter and a first dynode layer and the edge emitter is negative with respect to the first dynode layer, electrons are driven off the point-like edge the same as in the well known Spindt cathodes. These field emission electrons are driven to a first dynode layer where they bombard it and produce more electrons by secondary emission. Again, this increased number of electrons are next directed toward a second dynode where they are collected and again amplified for eventual delivery to the light emitting layer of the display device (not pictured here).

Due to the lateral layering of the electron multiplier structure, there will be minimal damage to edge emitter(s) caused by sputtering ions returning to the emitter. Ions are generated by electrons moving toward the anode under high voltage. Colding with gas molecules enroute to the anode, the gas molecule becomes a positive ion and an electron is emitted. A positive ion—being large in mass—races towards the cathode to find and recapture its lost electron. Upon impact with the cathode, cathode material is released by sputtering. In Spindt "cone shaped" microtips, erosion of the tip occurs. Thus, conventional FED devices employ a very high vacuum to reduce the number of gas molecules available to collide with. However, in addition to using a vacuum, the narrow electron multiplier structure of this invention sicantly decreases the possibility that a returning ion will strike an edge emitter.

As described, the features of the FED device will provide for a high-brightness field emission display with improved operating characteristics and durability. The feature of a radioactive emitter in the context of an "all-film" device will contribute to the reduction of the emitter to phosphor gap, as well as eliminate or reduce vacuum requirements. An improved electron multiplier structure may decrease tip erosion of emitters, and improve secondary electron emissions. Finally, an overall simplified structure will decrease manufacturing costs for FED devices.

While the presently preferred embodiments of the invention have been illustrated and described, it will be understood that those and yet other embodiments may be within the scope of the following claims.

What is claimed is:

1. An electron amplification device for producing secondary emissions of electrons, comprising:

a channel structure having a bottom wall coupled to at least one side wall to define a channel cavity;

at least one protrusion extending from said side wall into said channel cavity, each said protrusion formed on an end of a dynode layer, each dynode layer disposed between two insulating layers; and a primary electron source for providing primary emission of electrons into said channel cavity, whereby secondary emissions of electrons are produced when said protrusion is bombarded by electrons emitted by said primary electron source within said channel structure.

2. The electron amplification device of claim 1 wherein said protrusion comprises a high amplification factor material.

3. The electron amplification device of claim 1 wherein said side walls comprise a plurality of dynode layers and a plurality of insulating layers, thereby producing enhanced secondary emissions of electrons.

4. The electron amplification device of claim 3 wherein each of said plurality of said dynode layers are electrically interconnected by differential voltage sources, thereby amplifying secondary emissions of electrons.

5. The electron amplification device of claim 1 wherein said protrusion extends a distance on the order of about 1,000 Angstroms into said cavity.

6. The electron amplification device of claim 1 wherein said dynode layers comprise a layer on the order of about 3,000 Angstroms thick.

7. The electron amplification device of claim 1 wherein said insulating layers comprise a layer on the order of about 5,000 Angstroms thick.

8. The electron amplification device of claim 1 wherein said protrusion comprises material selected from the group comprising copper-beryllium, gold-barium, copper-barium and silver-magnesium.

9. The electron amplification device of claim 1 wherein an exposed edge surface of said protrusion comprises a near-monomolecular oxide surface area for producing enhanced secondary electron emissions.

10. The electron amplification device of claim 9 wherein said oxide surface area comprises material selected form the group comprising of barium oxide, beryllium oxide, magnesium oxide, calcium oxide and strontium oxide.

11. The electron amplification device of claim 1 further comprising a voltage source coupled to electrically bias the primary electron source with respect to said dynode layer.

12. The electron amplification device of clam 11, wherein the exposed edge surfaces of said insulating layers provide secondary emissions of electrons due to a capacitively distributed voltage across the dynode layer.

13. A cathodoluminescent display device, which comprises:

a faceplate through which emitted light is transmitted from an inside surface to an outside surface of the faceplate for viewing;

a cathode emitter for providing primary emission of electrons;

an anode, comprising a layer of electrically conductive material disposed between the inside surface of the faceplate and the cathode emitter;

a light emitter layer of cathodoluminescent material capable of emitting light through the faceplate in response to bombardment by electrons emitted within the device, disposed between the anode and the cathode emitter, an amplification layer disposed between said light emitting layer and said cathode emitter;

a cavity in said amplification layer, having a top wall formed by said light emitting layer, a bottom wall formed by said cathode emitter, and at least one side wall formed by said amplification layer; and at least one amplification protrusion formed on an end of a dynode layer disposed between two insulating layers and extending from said amplification layer into said cavity, said protrusion having an exposed edge surface positioned to be bombarded by primary electrons to produce secondary emissions of electrons within said device.

14. The cathodoluminescent display device of claim 13 wherein said protrusion comprises a high amplification factor material.

15. The cathodoluminescent display device of claim 13 wherein said amplification layer comprises a plurality of said dynode layers and a plurality of said insulating layers, thereby producing enhanced secondary emissions of electrons.

16. The cathodoluminescent display device of claim 13 wherein said amplification protrusion extends a distance on the order of about 1,000 Angstroms into said cavity.

17. The cathodoluminescent display device of claim 13 wherein said dynode layer comprises a layer on the order of about 3,000 Angstroms thick.

18. The cathodoluminescent display device of claim 13 wherein each insulating layer comprises a layer on the order of about 5,000 Angstroms thick.

19. The cathodoluminescent display device of claim 13 wherein said amplification protrusion material selected from the group comprising copper-beryllium, aluminum and magnesium.

20. The cathodoluminescent display device of claim 13 wherein the exposed edge surface of said amplification protrusion comprise a near-monomolecular oxide surface area for producing enhanced secondary electron emissions.

21. The cathodoluminescent display device of claim 20 wherein said oxide surface area comprises material selected from the group comprising beryllium oxide, aluminum oxide and magnesium oxide.

22. The cathodoluminescent display device of claim 13 further comprising a plurality of cavities in said amplification layer, whereby said plurality of cavities correspond to a pixel within said device.

23. A cathodoluminescent display device comprising:

a faceplate through which emitted light is transmitted from an inside surface to an outside surface of the faceplate for viewing;

a cathode emitter for providing primary emission of electrons;

an anode, comprising a layer of electrically conductive material disposed between the inside surface of the faceplate and the cathode emitter;

a light emitter layer of cathodoluminescent material capable of emitting light through the faceplate in response to bombardment by electrons emitted within the device, disposed between the anode and the cathode emitter;

an amplification layer disposed between said light emitting layer and said cathode emitter;

a gate electrode, wherein said gate electrode comprises a layer disposed between said light emitting layer and said amplification layer;

a cavity in said amplification layer, where said cavity extends through a recess in said gate electrode, the cavity having a top wall formed by said light emitting layer, a bottom wall formed by said cathode emitter, and at least one side wall formed by said amplification layer; and at least one amplification protrusion extending from said amplification layer into said cavity, said protrusion having an exposed edge surface positioned to be bombarded by primary electrons to produce secondary emissions of electrons within said device.

24. The cathodoluminescent display device of claim 23 further comprising a voltage source coupled between said gate electrode and a ground for applying a gating signal.

25. A cathodoluminescent display device comprising:

a faceplate through which emitted light is transmitted from an inside surface to an outside surface of the faceplate for viewing;

a cathode emitter for providing primary emission of electrons;

an anode, comprising a layer of electrically conductive material disposed between the inside surface of the faceplate and the cathode emitter;

a light emitter layer of cathodoluminescent material capable of emitting light through the faceplate in response to bombardment by electrons emitted within the device, disposed between the anode and the cathode emitter;

an amplification layer disposed between said light emitter layer and said cathode emitter;

a cavity in said amplification layer, having a top wall formed by said light emitter layer, at least one side wall formed by said amplification layer, and wherein said cathode electron emitter is deposited on an anode side of a substrate, wherein said cavity extends to said substrate through a recess in said cathode emitter, whereby an exposed surface on the anode side of said substrate forms a bottom wall of said cavity; and at least one amplification protrusion extending from said amplification layer into said cavity, said protrusion having an exposed edge surface positioned to be bombarded by primary electrons to produce secondary emissions of electrons within said device.

* * * * *

UNITED STATES PATENT AND TRADEMARK OFFICE

CERTIFICATE OF CORRECTION

PATENT NO. : 6,323,594 B1
DATED : November 27, 2001
INVENTOR(S) : John L. Janning It is certified that error appears in the above-identified patent and that said Letters Patent is hereby corrected as shown below:

Title page,
At Item "[56], References Cited", insert
-- OTHER DOCUMENTS
Dr. Jacques I. Pankove, "Electroluminescence", Spring-Verlag Berlin Heidelberg New York 1977, pp. 197-210 --

Column 2,
Line 57, "EOWV" should be -- HDTV --.
Line 66, "VFb" should be -- VFD --.

Column 3,
Line 18, "VH)" should be -- VFD --.
Line 24, "VFDS" should be -- VFDs --.
Line 25, "(FDs)" should be -- (FEDs) --.
Line 60, "unfnltered" should be -- unfiltered --.
Line 66, "trnisor" should be -- transistor --.

Column 4,
Line 2, "fags" should be -- fails --.
Line 10, "ified" should be -- filed --.

Column 7,
Line 10, "illustrate" should be -- illustrates --.

Column 8,
Line 3, "berylium" should be -- beryllium --.
Line 57, "Beryium" should be -- beryllium --.
Line 61, "ihibit" should be -- inhibit --.
Line 66, "e" should be -- emitting --.

Column 9,
Line 2, "a" should be -- an --.
Line 12, after "between" delete "the" (second occurrence).
Line 13, "phospher" should be -- phosphor --.

Column 10,
Line 41, "fnms" should be -- films --.
Line 46, "Ims" should be -- films --.

UNITED STATES PATENT AND TRADEMARK OFFICE

CERTIFICATE OF CORRECTION

PATENT NO. : 6,323,594 B1
DATED : November 27, 2001
INVENTOR(S) : John L. Janning It is certified that error appears in the above-identified patent and that said Letters Patent is hereby corrected as shown below:

Column 11,
Line 45, "S ir" should be -- Similar --.
Line 57, "alkali's" should be -- alkalis --.
Line 60, "cohmnm" should be -- column --.
Line 61, "copper-berylium" should be -- copper-beryllium --.
Line 64, "rubidiun" should be -- rubidium --.

Column 12,
Line 64, "channels" should be -- channel --.

Column 14,
Line 16, "Colding" should be -- Colliding --.
Line 26, "sicanthy" should be --significantly --.

Column 15,
Line 18, "form" should be -- from --.

Column 16,
Line 8, after "protrusion" insert -- comprises --.

Signed and Sealed this

Fourth Day of June, 2002

*Attest:*

*Attesting Officer*

JAMES E. ROGAN
*Director of the United States Patent and Trademark Office*